United States Patent [19]

Suzuki

[11] Patent Number: 5,029,446

[45] Date of Patent: Jul. 9, 1991

[54] ELECTRONIC COMPACT REFRIGERATOR

[75] Inventor: Nobuaki Suzuki, Tokyo, Japan

[73] Assignee: Kabushiki Kaisha B & D Japan, Tokyo, Japan

[21] Appl. No.: 500,702

[22] Filed: Mar. 28, 1990

[30] Foreign Application Priority Data

Aug. 15, 1989 [JP] Japan ..... 1-209548
Aug. 18, 1989 [JP] Japan ..... 1-211268

[51] Int. Cl.[5] ..... F25B 21/02

[52] U.S. Cl. ..... 62/3.6; 62/3.61; 62/457.7; 62/457.9

[58] Field of Search ..... 62/3.6, 3.61, 457.7, 62/457.9

[56] References Cited

U.S. PATENT DOCUMENTS 3,500,649 3/1970 Feldman ..... 62/3.6
4,364,234 12/1982 Reed ..... 62/3.6 X
4,671,070 6/1987 Rudick ..... 62/3.6
4,823,554 4/1989 Trachtenberg et al. ..... 62/3.61
4,916,923 4/1990 Adams et al. ..... 62/457.7 X

*Primary Examiner*—Lloyd L. King
*Attorney, Agent, or Firm*—Spensley Horn Jubas & Lubitz

[57] ABSTRACT

Here is disclosed a compact refrigerator to cool containers filled with soft drink or the like, particularly such refrigerator miniaturized and flattened so as to be installed near by a crample seat of minicar. This compact refrigerator comprises a container supporting member formed with a plurality of wells arranged side by side in a line to receive the containers, a heat exchanging mechanism functioning under a heat absorption effect of a thermoelectric cooling element, and a casing provided with a pivotal cover and said heat exchanging mechanism, thus presenting a flattened box-like configuration.

9 Claims, 7 Drawing Sheets

ELECTRONIC COMPACT REFRIGERATOR

BACKGROUND OF THE INVENTION

1. Field of the Invention

The present invention relates to a compact refrigerator adapted to cool containers filled with soft drink or the like and, more particularly, to an electronic compact refrigerator of flat type suitable to be installed within a limited space and also useful as the portable one.

2. Background Art

Various compact refrigerators are well known in the form of, for example, the home electric refrigerator or the cooler box for leisure time amusement. The compact refrigerators of well known art include also the refrigerator for business purposes which has an automatic vending function and often installed in the guest room of hotel.

Such compact refrigerator of prior art has been similar to the large-sized one so far as it comprises components such as compressor, condenser and evaporator and utilizes Freon gas as refrigerant to cool the interior of refrigerator.

The home electric refrigerator has been commonly used as one of the most important living necessaries to provide the comfortable living environment because it is able to store foodstuff without impairing freshness, taste and nutrition thereof, and said refrigerator having the automatic vending function has become service means adapted to offer cooled soft drink or the like readily and conveniently.

Recently a demand has come into existence, as the standard of living has risen, that every room should be provided with, in addition to a TV set, an electric refrigerator. There has arisen also a demand for development of the related products such as a portable canteen incorporated with a correspondingly miniaturized cooling device and a compact refrigerator adapted to be installed near by a cramped seat in a minicar. Such development will make it possible to carry food and drink requiring to be kept cooled easily and anywhere and thereby to further enrich the living environment as well as the leisure environment.

While there have already been available various services on traffic facilities such as taxi, bus, streetcar and railway train, it is also demanded for these traffic facilities to offer cooled soft drink or the like in easy and convenient manner.

However, the refrigerator itself must be further miniaturized in order to satisfy the various demands as mentioned above and such miniaturization is encountered by some problems so far as the refrigerator is based on the well known principle of refrigeration. Specifically, the refrigeration has been achieved, in accordance with the conventional principle, by the cooling cycle comprising jet evaporation and compression of refrigerant, so that the large-sized components and movable parts such as compressor and condenser have been necessary and such requirement has usually imposed a certain limitation on miniaturization of the refrigerator. Furthermore, it will be difficult to obtain a portable refrigerator, even if the above-mentioned components are miniaturized to some extent.

SUMMARY OF THE INVENTION

In view of the state of art as has been described above, it is a first object of the invention to develop an electronic compact refrigerator adapted to cool containers filled with soft drink or the like utilizing a thermoelectric cooling element.

It is a second object of the invention to develop an electronic compact refrigerator adapted to cool different-sized containers filled with soft drink or the like simultaneously.

It is a third object of the invention to develop an electronic compact refrigerator allowing containers stored therein to be externally visible.

It is a fourth object of the invention to develop an electronic compact refrigerator not only adapted to cool containers filled with soft drink or the like but also having an automatic vending function.

Said first object is achieved, according to the invention, by an electronic compact refrigerator comprising a flat box-like casing provided on its top with a pivotal cover, a thermally conductive container supporting member provided with a plurality of wells arranged side by side in a line to receive containers filled with soft drink or the like, and a heat exchanging mechanism provided within said casing to cool said container supporting member under a heat absorption effect of a thermoelectric cooling element.

Said second object is achieved, in accordance with the invention, by providing said supporting member with a plurality of wells having different depths or inner diameters or by providing adapters having therein wells to receive the respective containers and adapted to be inserted into the associated ones of said plural wells of the supporting member.

Said third object is achieved, according to the invention, by forming said casing entirely or partially from transparent material and forming said container supporting member also from transparent material.

Said third object is also achieved, according to the invention, by forming only pivotal cover of the casing from transparent material or, in case that the container supporting member is made of opaque material such as metallic material, by providing the container supporting member with vertically elongate slit-like windows extending through a front wall of said supporting member to the respective wells.

The fourth object is achieved, in accordance with the invention, by incorporating an automatic vending mechanism having a coin slot into said casing and providing this automatic vending mechanism with a locking device adapted normally to lock each container stored within the refrigerator but to unlock this containers in response to a coin thrown into the automatic vending mechanism through said coin slot so that the containers may be freely taken out from the refrigerator.

DESCRIPTION OF THE PREFERRED EMBODIMENT

The first embodiment of the invention will be first described in reference with the accompanying drawings.

Figure 1:
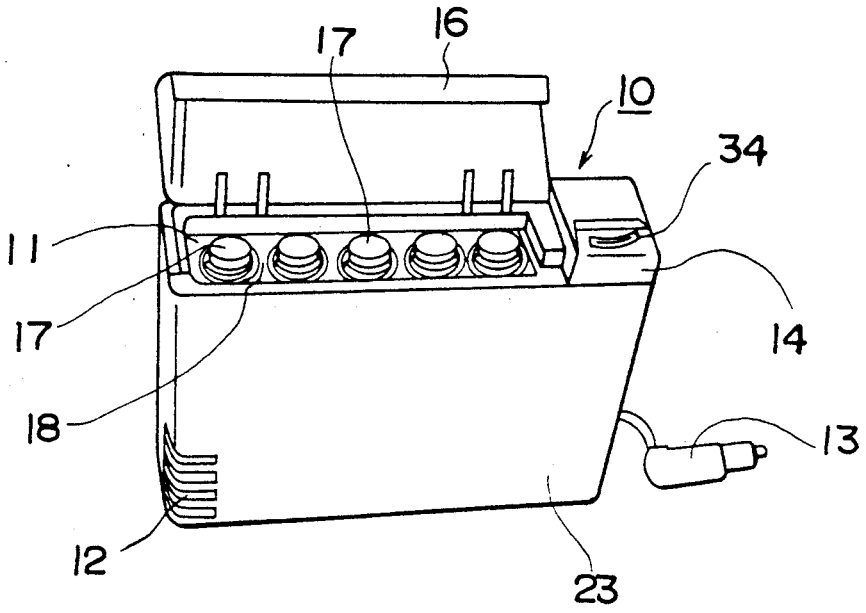
FIG. 1 is a perspective view showing a compact refrigerator constructed as a first embodiment of the invention with containers filled with soft drink or the like stored therein.
Figure 2:
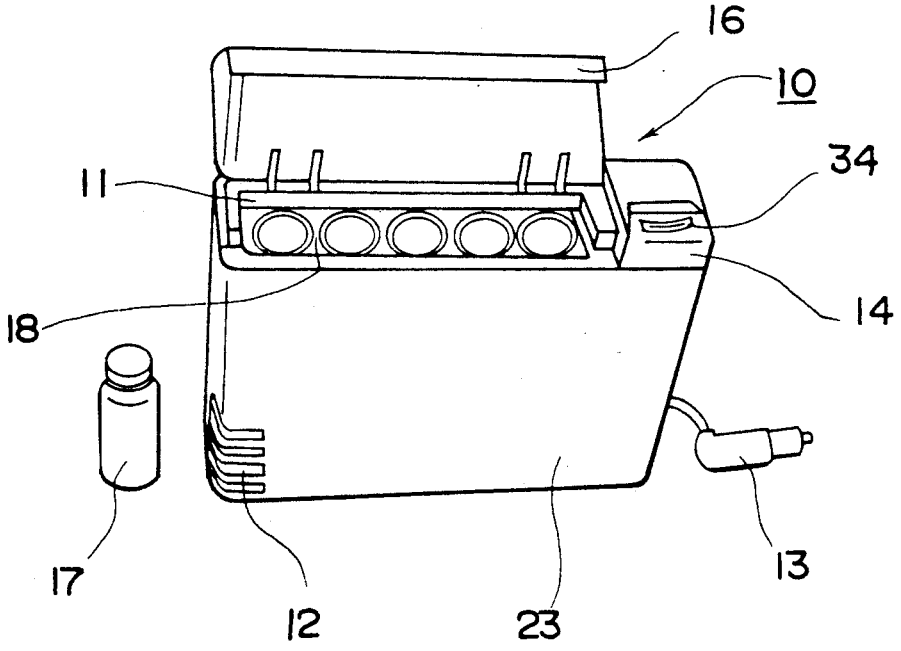
FIG. 2 is a view similar to FIG. 1 but showing the compact refrigerator as after all of the containers have been taken out therefrom.
Figure 3:
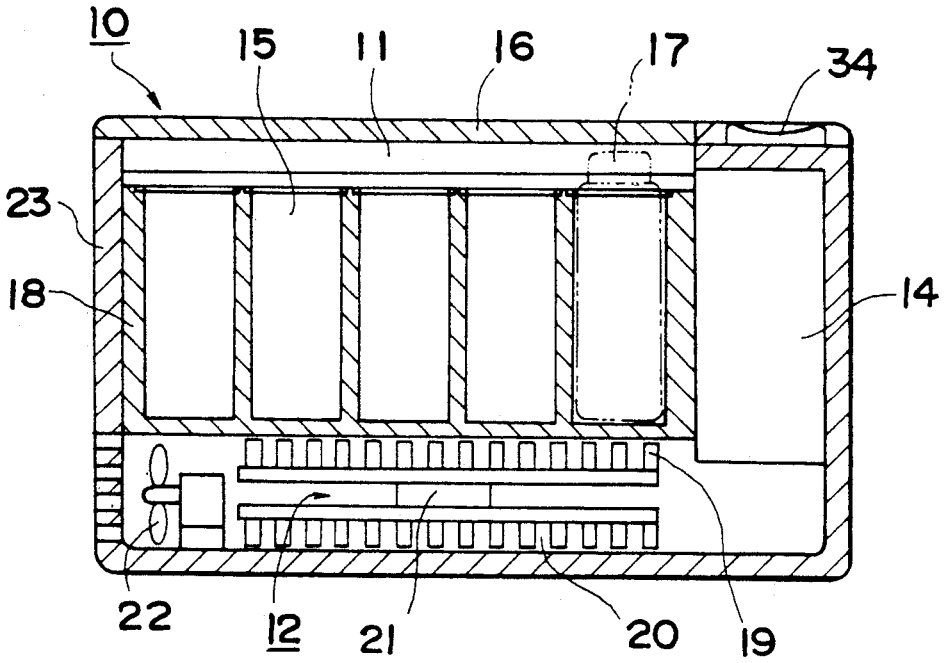
FIG. 3 is a vertical sectional view of said compact refrigerator.
Figure 4:
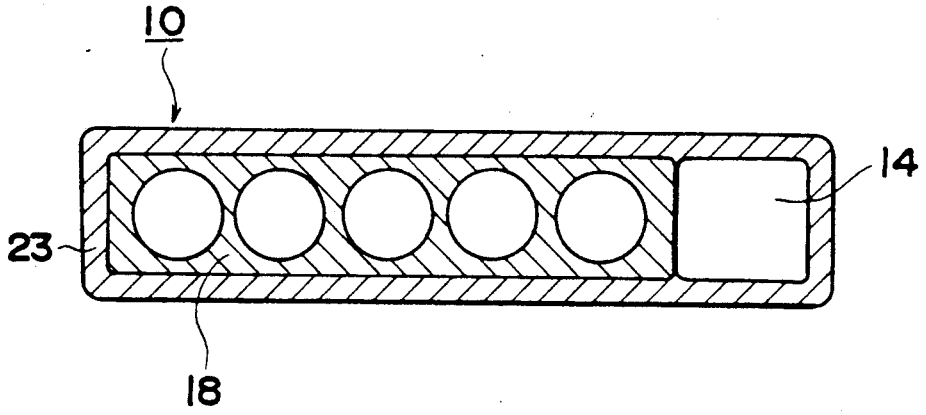
FIG. 4 is a horizontal sectional view of said compact refrigerator.

FIG. 1 is a perspective view showing a refrigerator with a cover being opened. FIG. 2 is a view similar to FIG. 1 but showing the refrigerator as after all of containers have been taken out therefrom, FIG. 3 is a vertical sectional view of said refrigerator and FIG. 4 is a horizontal sectional view of said refrigerator.

As illustrated, this refrigerator 10 comprises a flattened box-like casing 23 provided on its top with a pivotal cover 16, and, within said casing 23, a refrigerating section 11, a heat exchanging mechanism 12 and an automatic vending mechanism 14.

Said refrigerating section 11 comprises a plurality of container storing chambers 15 formed within the casing 23 and said container storing chambers 15 are defined by a container supporting member 18 which is a rectangular body of metallic material. It should be understood that there is provided thermally insulative material (not shown) between the container supporting member 18 and the casing 23. Said container supporting member 18 is formed with a plurality of cylindrical wells so as to receive five (5) containers 17 side by side in a line and a depth of each well is so simensioned that a head of the container 17 received by the associated well is exposed above the associated container storing chamber 15 when the cover 16 is pivotally opened.

Said heat exchanging mechanism 12 is adapted to be fed from a power source plug 13 and comprises inner and outer radiators 19, 20 in the form of heat exchanging fins, a Peltier element 21 in the form of thermoelectric cooling element, and a fan 22. The respective wells of said container supporting member 18 are cooled by this heat exchanging mechanism 12.

Figure 5:
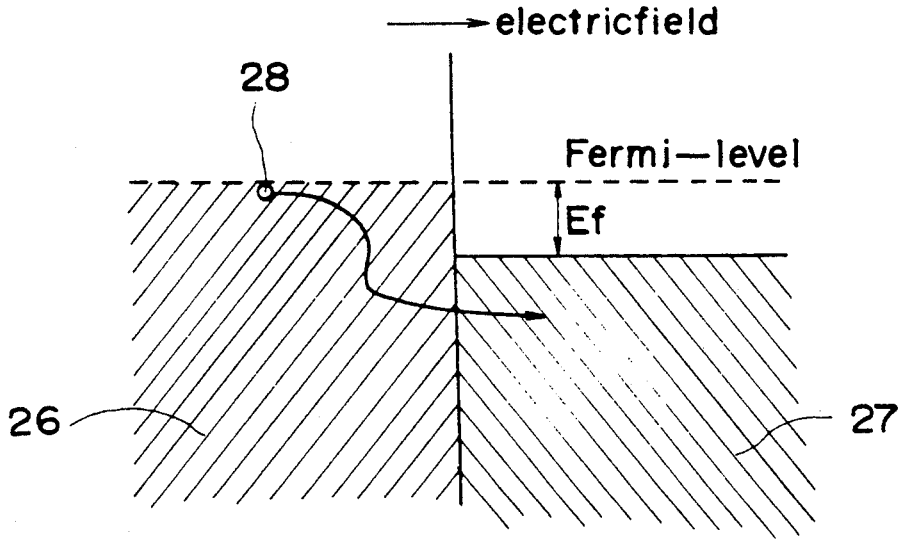
FIG. 5 is a diagram principally illustrative of a Peltier element.

A principle of the Peltier element 21 will be discussed. As will be apparent from FIG. 5, the Peltier element 21 comprises a metallic bass 26 and a P-type semiconductor 27 joined together so that heat absorption or generation of heat other than Joule heat occurs along a junction between said metallic mass 26 and said P-type semiconductor 27 as the Peltier element 21 is applied with electric current. Referring to FIG. 5, a positive hole 28 must have an energy of a Fermi-level qEf and a kinematic energy necessary to move within the semiconductor 27 in order to flow from the metallic mass 26 into the semiconductor 27. Therefore, the positive hole 28 must absorb the corresponding energy from the exterior. The average kinematic energy is in the order of (3/2)kT and is expressed by the following equation(1), in consideration of various factors such as an influence of scattering effect:

$$JI = \left(Ef + \frac{kT}{q} A\right) = \frac{kT}{q}\left(A + \ln \frac{2\,(2JIm^{*}kT)^{3/2}}{h^3 n}\right) \quad (1)$$

where $\pi$ represents a Peltier coefficient, Ef represents a Fermi-level, k represents a Boltzmann constant, T represents an absolute temperature, q represents an amount of electric charge, m* represents an effective mass of the positive hole, h represents a Plank's constant and A represents an influence of scattering.

The phenomenon as has been described above is commonly known as the Peltier effect. Upon inversion of the direction in which electric current flows, switching from heat absorption to heat generation occurs. In this case, a thermal energy is proportional to a current intensity and expressed by the following equation(2):

$$Q = \pi I \quad (2)$$

where Q represents the thermal energy and I represents the current intensity.

As will be understood from this equation(2), both the current intensity and the Peltier coefficient must be increased in order to increase the amount of absorbed heat. Since the Peltier coefficient largely depends upon the particular type and the characteristics of used semiconductor, it is important to select a high quality semiconductor which is high in its Fermi-level and substantially free from any adverse influence of scattering.

In this way, use of the Peltier effect eliminates a demand for the colling cycle with use of refrigerant as has conventionally been essential to the refrigerator of prior art, because use of the Peltier effect allows an electric energy to be directly utilized for heat absorption. Additionally, miniaturization of the refrigerator is advantageously facilitated by a fact that the heat absorption effect occurs along the juction area between substances of different species.

Figure 6:
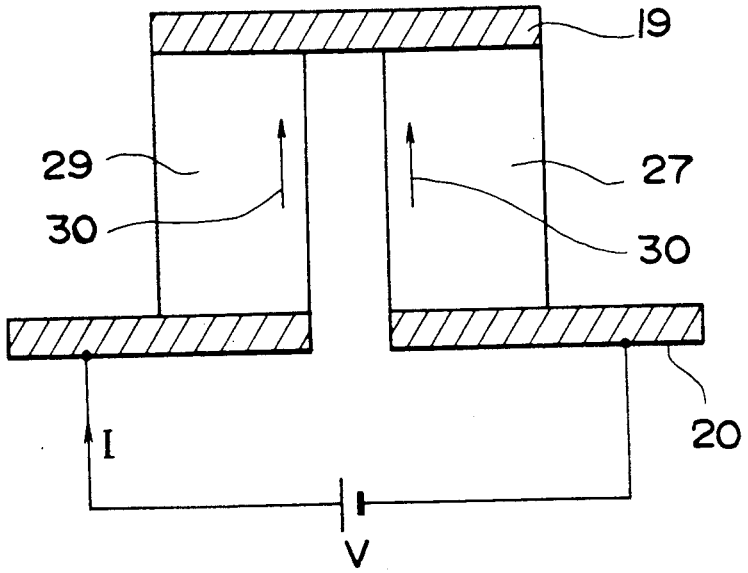
FIG. 6 is a diagram structurally illustrative of the Peltier element.

As seen in FIG. 6, there are provided the P-type semiconductor 27 and a n-type semiconductor 29 between metallic masses such the inner radiator 19 and the outer radiator 20, and application of electric current across these metallic masses results in generation of a heat flow as indicated by an arrow 30. In case of such element, the thermal energy absorbed by a cold junction from medium surrounding the element is expressed by the following equation(3):

$$Q = \alpha ITc - k(Th - Tc) - \tfrac{1}{2} IR^2 \quad (3)$$

where $\alpha$ represents a Seebeck coefficient, Tc represents a lower temperature, Th represents a higher temperature, k represents a thermal conductivity and R represents a resistance value. It should be understood that the inner radiator 19 functions as a heat collector within the refrigerating section 11 and the outer radiator 20 functions as a heat radiator.

Figure 7:
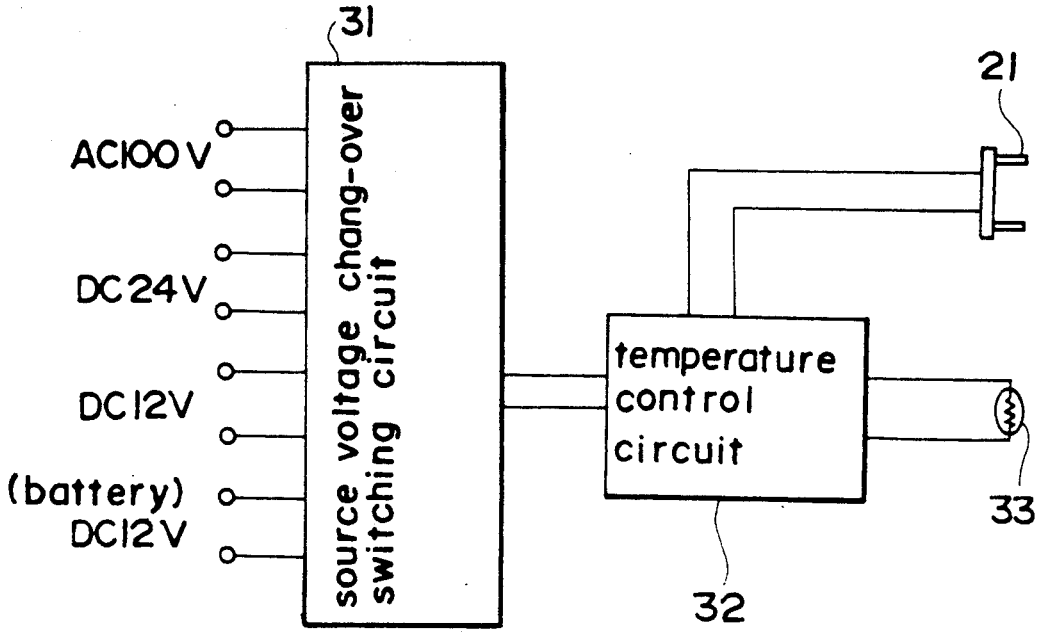
FIG. 7 is a schematic diagram of a feeder circuit.

A feeder circuit for the above-mentioned heat exchanging mechanism 12 comprises, as shown by FIG. 7, an AC 100 V power source, a DC 24 V power source, a power source change-over switching circuit 31 adapted to be connected by the power source plug 13 to said DC 12 V power source, and a temperature control circuit 32. The power source voltage change-over switching circuit 31 is adapted to be connected to a back-up DC 12 V power source comprising a battery contained within the refrigerator 10.

The power source voltage change-over switching circuit 31 is arranged to select a desired one of the respective power sources so that the temperature control circuit 32 is applied with power from this selected power source. Concerning the DC power sources of these available power sources, when the refrigerator is used as the vehicle-loaded refrigerator, the car battery may be used as the DC 24 V power source or as the DC 12 V power source by connecting the refrigerator to the car lighter socket. Moreover, the refrigerator 10 may be incorporated with a battery to be used as the back-up DC 12 V power source and a chargeable battery may be used as this back-up power source.

The temperature control circuit 32 contains therein a voltage comparator adapted to compare an output from a thermistor provided within the container storing chamber 15 with a preset value and thereby to supply the Peltier element 21 with electric current necessary to maintain the temperature within said container storing chamber 15 at said preset value.

The automatic vending mechanism 14 is provided with a coin slot 34 and responsive to a coin thrown into the mechanism 14 through said coin slot 34 to unlock one of the containers stored in the respective wells of the container supporting member 18 so that these containers may be freely taken out therefrom. In other words, when a coin of predetermined denomination is thrown into the mechanism 14 through the coin slot 34, a locking device (not shown) which has locked each container 17 is disabled. In this manner, the containers 17 may be taken out from the refrigerator 10 one by one every time a coin is thrown into the mechanism 14 through the coin slot 34.

Figure 8:
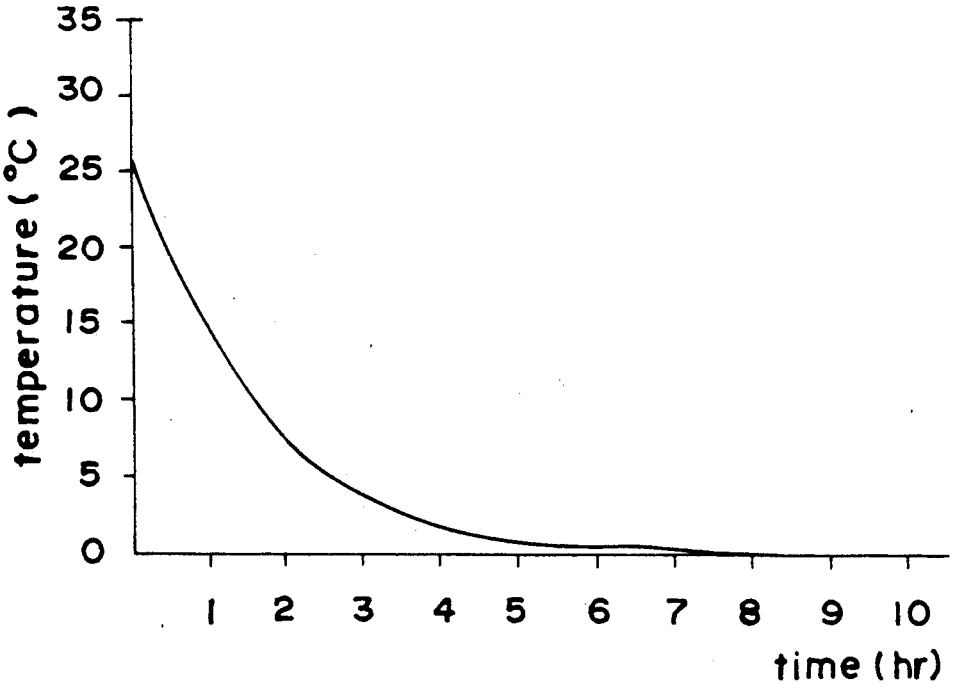
FIG. 8 is a graphic diagram showing cooling characteristic curve exhibited by a refrigerator having an inner volume of 0.25 l.

The refrigerator 10 according to this embodiment actually exhibited a cooling characteristic as shown by FIG. 8.

The cooling characteristic curve as shown in FIG. 8 was obtained by an experiment conducted on the refrigerator having an inner volume of 0.25 l at a temperature of 25° C. In this experiment, the inner temperature of the refrigerator was preset to 15° C. and heat radiation on the higher temperature side was achieved in air-ccoled mode with use of the fan 22. As will be apparent from FIG. 8, the temperature dropped to the preset value within ten (10) minutes.

Figure 9:
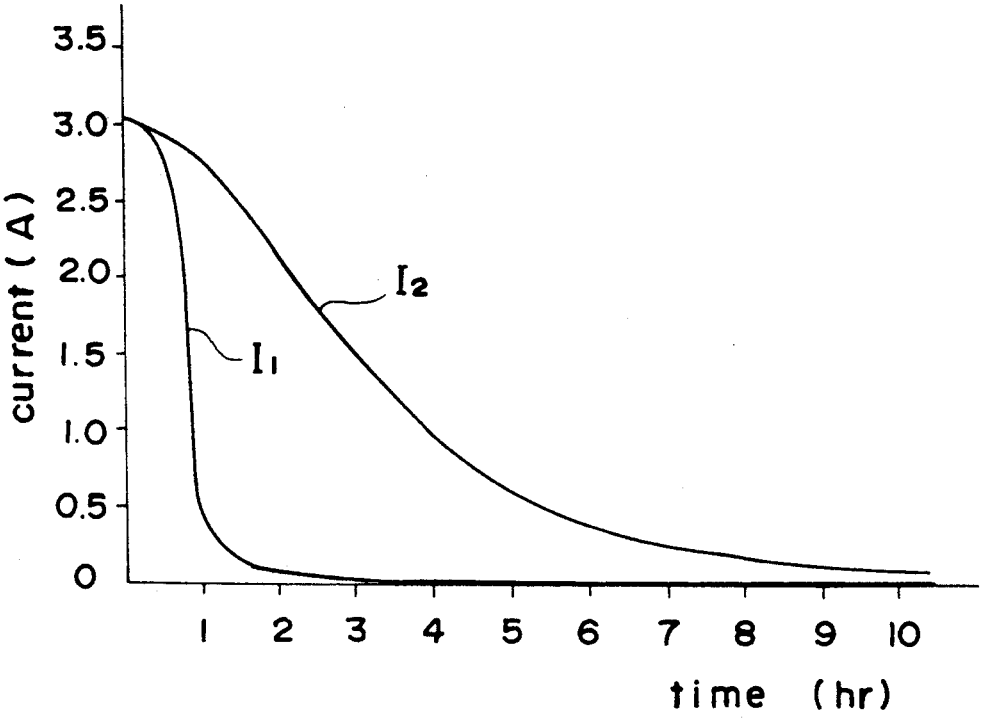
FIG. 9 is a graphic diagram showing a fluctuation characteristic curve of electric current flowing through the heat exchanging mechanism provided with the Peltier element.

As shown by FIG. 9, the electric current supplied to the Peltier element 21 actually exhibited a fluctuation characteristic such that the electric current sharply decreases to an extreme small value as the inner temperature approaches the preset value and, once said inner temperature has reached the preset value, only an amount of electric current necessary to maintain the interior of the refrigerator at said preset temperature flows through the Peltier element 21. While such minimum value of electric current largely depends upon a thermal insulating structure, it may be less than 0.1 A, namely a level as low as feedable from the back-up battery when the refrigerator is sufficiently miniaturized. Therefore, the power source may be switched to the back-up battery source after the inner temperature has been cooled to the preset value and thereby this compact refrigerator may be used as the portable one. It should be understood that, referring to FIG. 9, a characteristic curve $I_1$ is at the preset temperature of 15° C. while a characteristic curve $I_2$ is at a temperature of 0° C.

Figure 10:
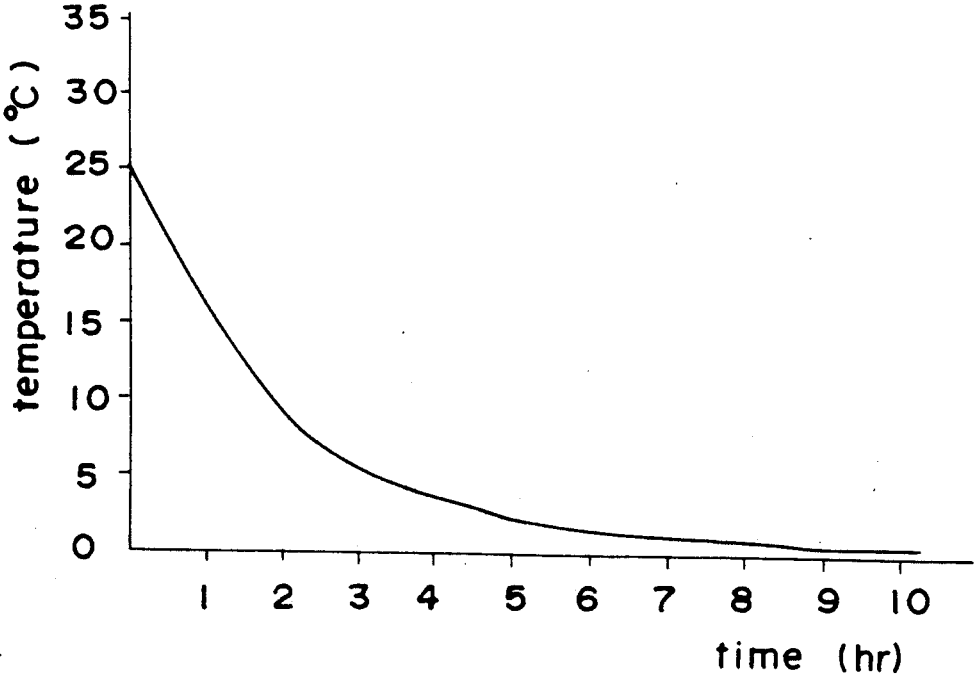
FIG. 10 is a graphic diagram showing a cooling characteristic curve exhibited within the respective containers stored in the refrigerator having the inner volume of 0.25 l.

FIG. 10 shows a cooling characteristic experimentarily obtained within the container(filled with soft drink) 17 of the refrigerator having an inner volume of 0.25 l at an ambient temperature of 25° C. As shown, the inner temperature was preset to 15° C. and heat radiation on the higher temperature side was achieved by air-cooled mode with use of the fan 22. In this case also, the temperature dropped to the preset value within ten (10) minutes.

In this manner, the container filled with soft drink or the like can be cooled within a short time, so such refrigerator 10 may be installed near by the seats of taxi, bus, streetcar, railway train and the like and thereby the service quality may be improved.

Figure 11:
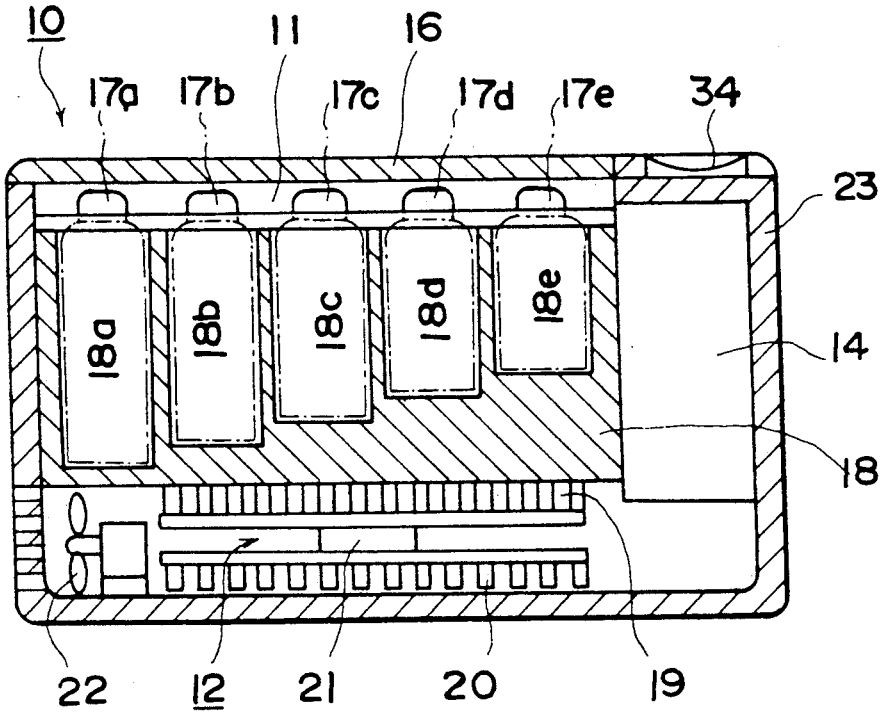
FIGS. 11 and 12 illustrate a second embodiment of the invention adapted for different-sized containers, FIG. 11 being a vertical sectional view of a compact refrigerator constructed according to this manner of embodiment and FIG. 12 being a horizontal sectional view showing a variante of the refrigerator shown by FIG. 11.

FIG. 11 is a vertical sectional view illustrating a refrigerator 10 constructed as a second embodiment of the invention.

This embodiment is characterized in that the container supporting member 18 is provided with five (5) cylindrical wells 18*a* through 18*e* of different depths arranged side by side in a line so that different-sized containers 17*a* through 17*e* may be stored and colled in the respective wells. In the embodiment shown, depths of the respective wells 18*a* through 18*e* are dimensioned so that the respective containers 17*a* through 17*e* of different lengths may be received in the associated wells with their heads being exposed above the mouths of the respective wells.

The respective wells 18*a* through 18*e* may be not only of different depths but also of different outer diameters so as to receive thick and thin containers.

Figure 12:
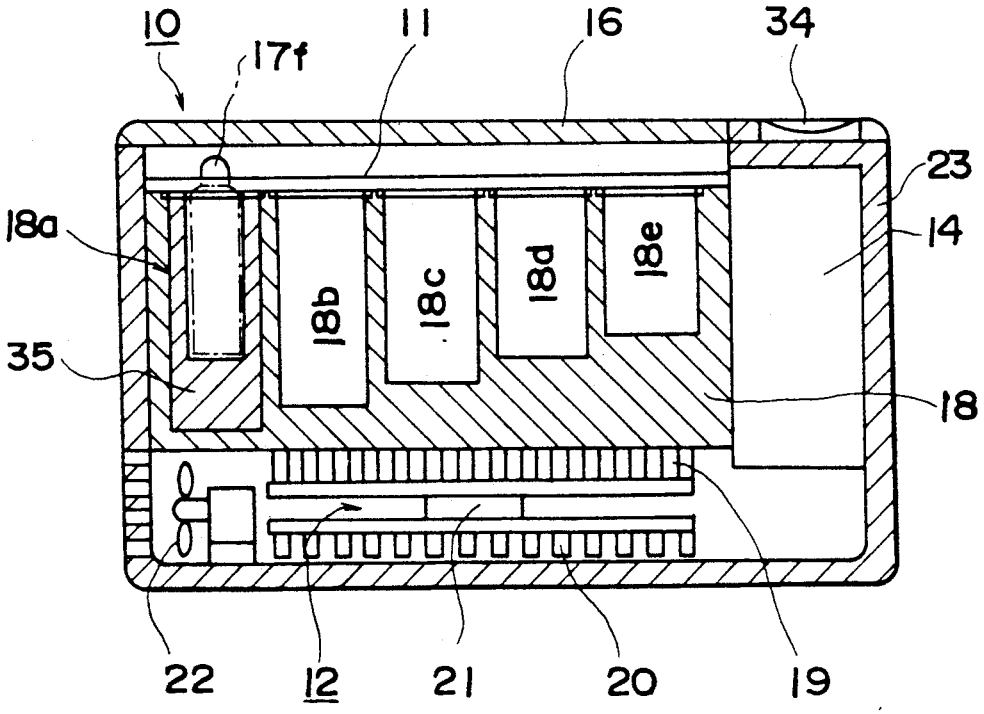

As shown by FIG. 12, there may be provided adapters 35 which are to be inserted into the respective wells 18*a* through 18*e* in order to limit the spaces defined by the respective wells. These adapters make it possible to cool a container 17*f* of a size which is too small to be properly received in any one of the wells.

The adapter 35 is formed from thermally conductive material such as aluminium in a cylindrical shape and has a longitudinal well to receive said small-sized container. These adapters 35 of several dimensions may be prepared for the respective wells 18*a* through 18*e* to be selectively used.

Figure 13:
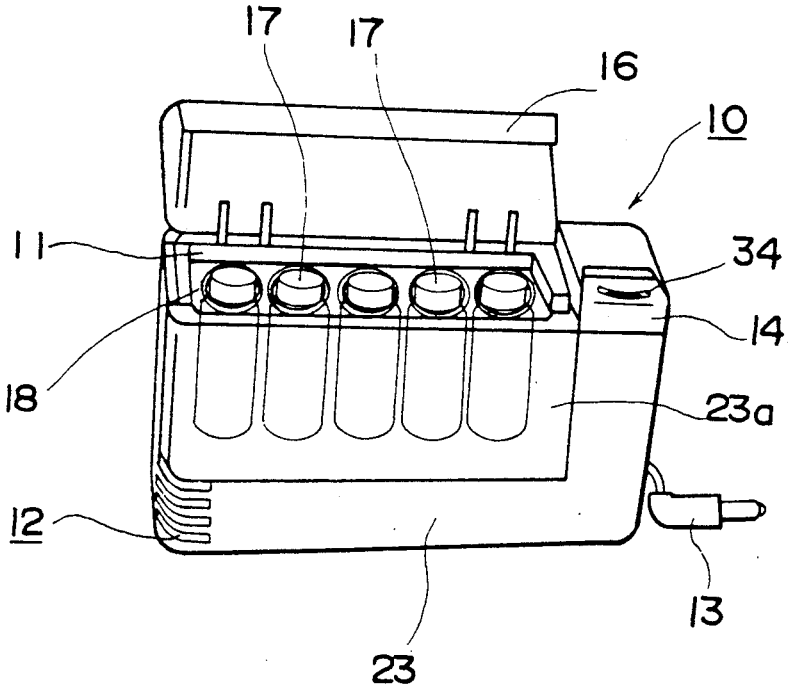
FIG. 13 is a perspective view showing a compact refrigerator constructed as a third embodiment of the invention so as to allow the containers stored therein to be externally visible.

FIG. 13 is a perspective view showing a refrigerator 10 constructed according to the third embodiment of the invention.

This embodiment is characterized in that a front wall 23*a* of the casing 23 and the container supporting member 18 provided within the casing are made of transparent material so that the containers 17 stored in the refrigerator 10 may be externally visible.

When the container supporting member 18 is formed from opaque metallic material, the front wall thereof may be formed at locations corresponding to the respective wells with vertically elongate slit-like windows. When there is provided thermally insulative material between the casing 23 and the container supporting member 18, transparent thermal insulator may be used or the thermal insulator may be partially cut off.

To make the containers stored in the refrigerator externally visible, it is also possible to form only the cover 16 from transparent material or to form both the entire casing 23 and the cover 16 from transparent material. Furthermore, it is also possible to replace said transparent material by translucent material.

With the third embodiment as has been mentioned just above, not only existence of the containers 17 stored in the refrigerator 10 can be visibly determined from the exterior but also, particularly when the refrigerator 10 is loaded on a car or the like, the refrigerator 10 can be utilized as advertizing means because labels or the like applied on the containers 17 can be externally visible.

Although the respective embodiments of the invention have been described above, it should be understood that incorporation of the automatic vending mechanism 14 is not essential to the invention.

What is claimed is:

1. An electronic compact refrigerator comprising:

a flat box-like casing;

a pivotal cover provided on the top of said casing a thermally conductive container supporting member provided within said casing, said container supporting member defining at least one well for receiving a container having an exterior side surface and an exterior bottom surface, said well of said container supporting member including a side wall and a bottom wall which come into close proximity to said exterior side surface and bottom surface , respectively, of the container and which cover substantially all of said exterior side surface and bottom surface of the container to thereby facilitate heat transfer between the container and said supporting member; and a heat exchanging means including a thermoelectric cooling element provided within said casing and thermally coupled to said container supporting member for cooling said container supporting member under a heat absorption effect of said thermoelectric cooling element.

2. An electronic compact refrigerator as recited in claim 1 further comprising an adapter to be received in said well of said supporting member, said adapter defining therein a second well for receiving a container having an exterior side surface and an exterior bottom surface wherein said second well includes a side wall and a bottom wall which come into close proximity to said exterior side surface and bottom surface, respectively, of the container and which cover substantially all of said exterior side surface and bottom surface of the container thereby effecting maximum heat transfer between the container and said adapter.

3. An electronic compact refrigerator as recited in claim 1, wherein said casing is entirely or partially formed from transparent material and said container supporting member is also formed from transparent material.

4. An electronic compact refrigerator as recited in claim 1, wherein only the pivotal cover of the casing is formed from transparent material.

5. An electronic compact refrigerator as recited in claim 1, wherein said casing is entirely or partially formed from transparent material, said container supporting member is formed from opaque material, and the container supporting member is provided through its front wall with slit-like windows extending to the respective wells.

6. An electronic compact refrigerator as recited in claim 1, wherein an automatic vending mechannism having a coin slot is incorporated into said casing and this automatic vending mechanism is provided with a locking device adapted normally lock each of the containers stored in the refrigerator but to unlock the container in response to a coin thrown into the automatic vending mechansim through said coin slot so that one of the containers may be freely taken out from the refrigerator.

7. An electronic compact refrigerator as recited in claim 1 wherein said container supporting member includes a plurality of wells for receiving containers therein.

8. An electronic compact refrigerator as recited in claim 7, wherein said plurality of wells of said container supporting member comprise different depths.

9. An electronic compact refrigerator as recited in claim 7, wherein said plurality of wells of said container supporting member comprise different inner diameters.

* * * * *